US005405271A

United States Patent [19]

Bauer et al.

[11] Patent Number: 5,405,271

[45] Date of Patent: Apr. 11, 1995

[54] APPARATUS AND METHOD FOR IMPROVING ASSEMBLY OF LEADLESS BALLASTS INTO FLUORESCENT LUMINAIRES

[75] Inventors: Fred P. Bauer, Mendenhall; Stuart E. Sanders, Brandon, both of Miss.

[73] Assignee: Magnetek Inc., Los Angeles, Calif.

[21] Appl. No.: 128,591

[22] Filed: Sep. 28, 1993

Related U.S. Application Data

[63] Continuation-in-part of Ser. No. 9,645, May 14, 1993, which is a continuation-in-part of Ser. No. 680,699, Apr. 4, 1991, Pat. No. 5,260,678.

[51] Int. Cl.[6] ..... H01R 13/629

[52] U.S. Cl. ..... 439/480; 439/296; 336/107; 29/758

[58] Field of Search ..... 439/476, 480, 296; 29/758, 278; 157/1.3; 336/96, 107; 174/DIG. 2

[56] References Cited

U.S. PATENT DOCUMENTS 792,009 6/1905 Downs ..... 157/1.3

1,569,310 1/1926 Trevorrow ..... 157/1.3

*Primary Examiner*—Gary F. Paumen

*Attorney, Agent, or Firm*—Seldon & Scillieri

[57] ABSTRACT

An assembly tool helps connect an electrical external half-connector to an internal half-connector at an aperture in a ballast case. The tool includes a fulcrum for stabilizing the tool against the case, and tongue for pushing the external half-connector into engagement while clearing the connector wires, to avoid damage. A handle of the tool is used to rotate the tool about the fulcrum. If the connector has a latch to deter pull-out, the tool also preactuates or depresses the latch to eliminate frictional resistance to inserting the latch—and so reduce the required engagement force. Latch depression is simultaneous with the point in the insertion process where the latch hook passes its mating engagement member. The tool dimensions provide a high mechanical advantage to help push the two connector halves together against friction. The tool converts the connector-engaging task from wrist action to a stress-free upper-body movement. Various fulcrum configurations are preferred for engaging existing features of the ballast case or luminaire, or both.

15 Claims, 8 Drawing Sheets

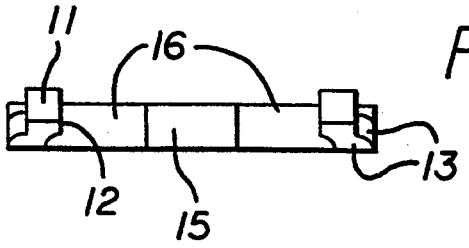
FIG. 8
FIG. 9
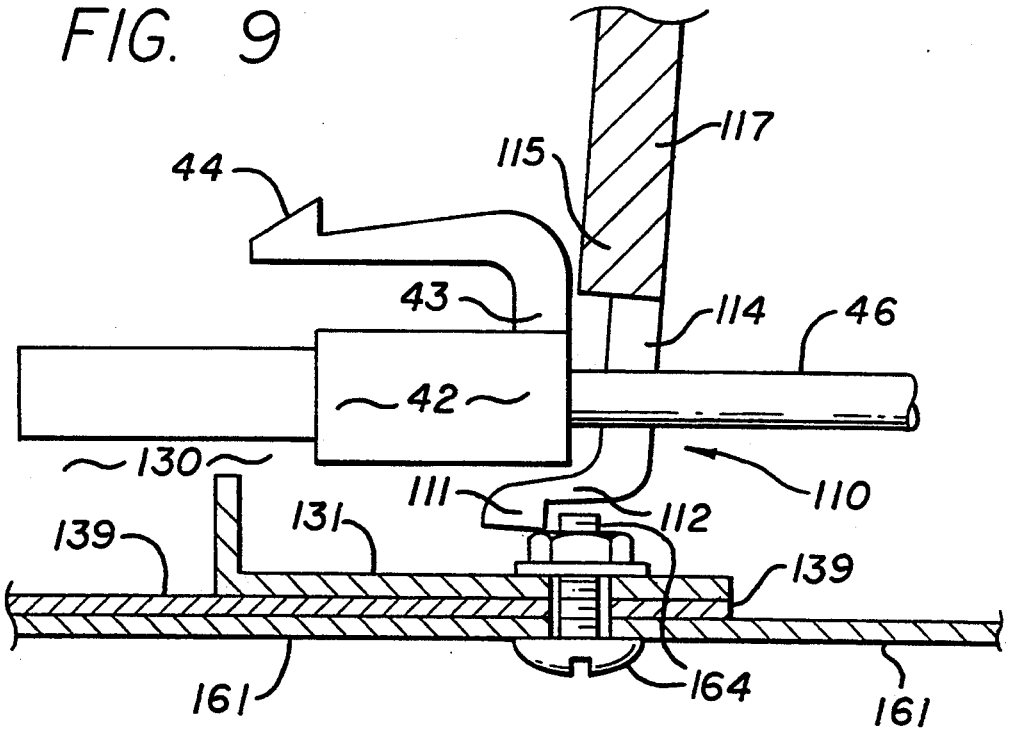

APPARATUS AND METHOD FOR IMPROVING ASSEMBLY OF LEADLESS BALLASTS INTO FLUORESCENT LUMINAIRES

RELATED PATENT DOCUMENTS

This is a continuation-in-part of utility-patent application Ser. No. 08/009,645, filed May 14, 1993, entitled "FLUORESCENT-LAMP LEADLESS BALLAST WITH IMPROVED CONNECTOR"; and of its parent Ser. No. 07/680,699, originally filed Apr. 4, 1991, now issued as U.S. Pat. No. 5,260,678, on Nov. 9, 1993, and hereby fully incorporated by reference into this document.

BACKGROUND

1. Field of the Invention

This invention relates generally to fluorescent lighting apparatus; and particularly to apparatus and method improving assembly of leadless ballasts into fluorescent luminaires.

2. Prior Art

Ignition and maintenance of electrical discharges in fluorescent lamps generally require voltages much higher than ordinary line voltages, and in some instances heater circuits in such lamps also require specific lower voltages. Fluorescent light fixtures, known as "luminaires", accordingly have special transformer assemblies, "ballasts", for providing these specialized voltages.

Traditionally electrical connections at each ballast were provided in the form of relatively long wires extending from within the ballast. At the time of installation of the ballast into a luminaire, such wires in many instances were then connected with wire nuts to wires (provided by the luminaire manufacturer) running within the luminaire to electrodes and power terminals of the luminaire.

Such connections were time consuming and required some degree of special expertise—to make a good connection, as well as to complete the various circuits correctly. These awkwardnesses were particularly troublesome when ballasts required aftermarket replacement.

In other instances the ballast wires were long enough (usually just long enough) to connect directly to the electrodes and terminals. Such connections represented an improvement in that they were no more difficult than connecting the first-mentioned style of wiring into a luminaire—and one wiring step was thus eliminated.

Such ballasts with long wires, however, generally had to be made up specially for each luminaire type, introducing undesirable manufacturing inefficiencies and inventorying costs. Field replacement was also particularly onerous.

During the last few years, therefore, the fluorescent lighting industry has been turning to ballasts with no external leads—so-called "leadless ballasts". In such a ballast the leads terminate internally at a half-connector that is mounted in (or forms part of) the wall of the ballast case; this half-connector is most often aligned with (sometimes in the sense that it provides) an aperture in the wall.

For purposes of the present document, such a half-connector will be called an "internal" half-connector, as it is internal to the ballast case.

Upon installation of such a ballast into a luminaire, the wiring connections are most typically made by attaching a mating external half-connector that is wired to the luminaire electrodes and terminals. (Alternatively in some cases the luminaire wires are instead inserted individually into female terminals in the internal half-connector.)

Preferred designs make use of female half-connectors—often called "sockets" or "receptacles"—as the internal half, and male half-connectors or "plugs" for the external. One reason for this preference is the associated lower vulnerability to breakage of electrical equipment protruding from the ballast case during shipment and storage; however, the opposite design is also feasible, and the present invention is compatible with both.

Leadless-ballast configurations should be made reasonably safe in event of various sorts of adverse field conditions that stress the ballast-to-luminaire interface. For this purpose connectors are favored which incorporate latches to hold the two half-connectors together—even against considerable separating force, such as might arise for instance if a ballast were to fall out of a luminaire and hang by the wiring connections, or if inexperienced personnel were to tug strongly at the luminaire wires.

Generally the level of separating force which such a latch must withstand is considered to be twenty pounds. Many or most luminaire manufacturers now refuse to buy a leadless ballast that lacks a latch; and the latch-style connector is regarded as important to acceptance of leadless-ballast configurations not only by manufacturers but as well by testing laboratories that service the consumer-product industries.

The latch ordinarily takes the form of a hook-shaped retaining element, with an inclined-plane back portion that is used to deflect the hook during mutual engagement of the two half-connectors. This retaining element is resiliently mounted to one (usually the external one) of the half-connectors—most commonly by being formed in the material of that half-connector.

During assembly the hook is deflected by force applied against the inclined-plane back portion of the hook, and so moves in ratchet fashion past a retaining edge that is associated with the other half-connector. When this other half is the internal half-connector (as is usually the situation), for the sake of economy the retaining edge may be an edge of the aperture in the metal ballast-case wall; otherwise the retaining edge is supplied as part of the molded plastic half-connector body, adding significantly to the amount of plastic required.

After passing the retaining edge, the hook or like retaining element snaps resiliently into place behind that edge, providing the desired resistance against pull-out of the external half-connector. Notwithstanding such force, the side of the hook which now engages the retaining edge remains in engagement—because that side is not inclined—but whenever a user wishes to disconnect the ballast, the user can disengage the hook manually, by manually depressing the retaining element.

The use of mating half-connectors inside and outside the ballast case, despite the added cost of the connectors and additional procedures for wiring both halves, has been found very satisfactory—particularly as it greatly facilitates assembly (including field replacement), and confers substantial benefits of modularity in manufacture and inventorying.

Luminaire assembly work proceeds so much more quickly, however, that an unexpected ancillary difficulty arises. Some assembly-line workers have reported discomfort in their hands, seemingly arising from the repetitive work of forcibly inserting the external half-connectors into engagement with the internal half-connectors.

Some suggestion has been heard that such discomfort, and perhaps possibly eventual progressive disability, may arise from a phenomenon known in industry and elsewhere as "carpal tunnel syndrome". In any event, in practical terms this development is evidently associated with a repetitive wrist motion, under compression, needed to push the external half-connector into engagement.

During this motion the components tend to be essentially always in the same assembly-line position relative to the worker's stance. It appears that such effort could tire an operator on a longterm basis.

Such problems generally are incurred in the assembly facilities of luminaire manufacturers, representing a real and significant problem in some cases for the acceptability and hence the utility of lead less-ballast configurations. As can now be seen, important aspects of the technology in the field of the invention are amenable to useful refinement.

SUMMARY OF THE DISCLOSURE

The present invention introduces such refinement. Before offering a relatively rigorous discussion of the present invention, some informal orientation will be provided here.

It is to be understood that these first comments are not intended as a statement of the invention. They are simply in the nature of insights that will be helpful in recognizing the underlying character of the prior-art problems discussed above; such insights are considered to be a part of the inventive contribution associated with the present invention.

The present inventors have noted that the force required to interengage the two half-connectors can be resolved into two components: (1) friction of the outer surfaces of one half-connector body, and outer surfaces of male connector pins, against inner surfaces of the other connector body and inner surfaces of female connector pins, and (2) friction of the retaining edge against the inclined-plane back side of the resiliently mounted retaining element.

The invention proceeds to mitigate the above-described assembly problems by addressing these two elements of the resistive force independently. As will be seen, the resulting solution makes particularly efficient use of assembly-worker exertion.

By good connector body and pin design, the first of these components can be held low—but not eliminated. To the extent that the remaining frictional resistance is troublesome to assembly workers, it is susceptible to mitigation through application of mechanical advantage—or powered assistance—in the insertion effort.

The second frictional component, when present (that is to say, when the connector is a latch-style connector), can be a greater or lesser contributor to the problem, depending on the materials of construction, surface finish, and angle of the inclined plane. These and possibly other factors determine the effective overall coefficient of friction that operates against the assembly worker; the problem is typically aggravated, for example, in devices with latches made of metal.

Even the smoothest of practical inexpensive-production retaining latches, however, is responsible for a significant undesired force level during insertion. We believe, therefore, that efforts to reduce the-effective overall coefficient of friction in the connector would be misdirected—particularly as the friction can be eliminated entirely at the cost of relatively little force applied in a different direction.

This can be accomplished by displacing the retaining element so that it entirely clears the retaining edge during insertion. This function can be performed without major effort simply by taking advantage of the provision already made, in the connector itself, for manual deflection of the hook during disengagement of the connector halves.

This tactic causes the latch to pivot about the base. Although some force is required to accomplish such pivoting, this technique comes out ahead because there is no coefficient of friction in only pushing straight in against the back of the latch member.

The present invention seeks to help the assembler overcome come both components of frictional resistance, by using a simple insertion tool and process.

Now with these preliminary observations in mind this discussion will proceed to a perhaps more-formal summary. In its preferred embodiments, the present invention has several independent aspects or facets.

In preferred embodiments of its first such independent aspect, the invention is an assembly tool. The tool is for use in assembling an electrical-illumination ballast that has a case, and an electrical external half-connector to be positioned at an aperture in a wall of the case; the case has an electrical internal half-connector prealigned at the aperture, for engagement with the external half-connector.

The tool includes some means, providing a fulcrum, for stabilizing the tool relative to the case of such an electrical-illumination ballast. For purposes of generality and breadth in describing the invention we will call these means simply the "fulcrum means".

The tool also includes some means for advancing or pushing the external half-connector into engagement with the internal half-connector. Once again for breadth and generality these means will be called the "advancement means".

Also included are some means for rotating the tool about the fulcrum means. These means incorporate a manually operable handle, and will be called the "manually operable handle means".

These handle means are for rotating the tool about the fulcrum means when the fulcrum means are stabilizing the tool relative to the case—to urge the advancement means against the connector, to push the external half-connector into engagement with the internal half-connector.

The foregoing may be a description or definition of the first facet of the invention in its broadest or most general form. Even in this form, however, as can now be appreciated this first aspect of the invention importantly reduces the problems of the prior art presented earlier in this document.

In particular, the tool as thus described introduces an opportunity for application of a mechanical advantage to the task of pushing the two connector halves together against the frictional-force components identified above. The tool also introduces opportunities, since the necessary insertion force is lower, for the assembly worker to perform this task using a greater variety of hand positions and stances: by using the tool in an intuitive or natural way, the worker readily converts the connector-engaging task from wrist action to a stress-free upper-body movement.

Accordingly in these two ways the insertion tool even in its most general form makes an important contribution to relief of the assembly worker's distress. Nevertheless we prefer to practice the invention in conjunction with certain additional features or characteristics that enhance enjoyment of the benefits of the invention.

For example, if the tool is for use particularly with a case that has means for mounting the case to a luminaire, then it is preferable that the fulcrum means comprise elements for engaging the case-to-luminaire mounting means. Further in such a situation if the case-to-luminaire mounting means include a longitudinally extending flange, and at least one ballast-mounting hole in the flange, then preferably the fulcrum means include elements for engaging that at least one hole; in this arrangement the mounting hole does double duty as a stabilizing element during assembly, without any added cost for providing the stabilizing element.

Further still if there are at least two ballast-mounting holes in the flange, then preferably the fulcrum means include elements for engaging at least two of the ballast-mounting holes. By this arrangement the tool is steadied laterally for directing the advancement means at a correct angle to the case—thus facilitating operation of the tool with any of a great many different hand positions, as mentioned just above.

If the tool is for use particularly with a case whose case-to-luminaire mounting means include at least one hole for passage of at least one fastener that engages the luminaire, then preferably the fulcrum means include elements for engaging the at least one fastener. Here too, the fastener is made to double as an assembly-tool anchor without adding any cost to the device.

If the tool is for use particularly in making electrical connections to a ballast case that is already premounted to a luminaire, then another preferred alternative is that the fulcrum means include elements for engaging the luminaire. As will be understood by persons skilled in the art, any of these arrangements has the effect of stabilizing the tool relative to the case—either the case directly, or some other element that is generally fixed in relation to the case.

Preferably the engaging elements of the fulcrum means are at an angle to the handle means. This arrangement often eases the process of hooking the fulcrum onto the case or other element with a minimum number of extra motions and with minimum required care.

Preferably too the advancement means of the tool include some means for engaging the connector body, but also some means for, at the same time, mechanically clearing wires that extend from the body. Such a configuration is desirable to minimize likelihood of damaging the wires.

In preferred embodiments of a second of its facets or aspects too, the invention is an assembly tool—for use similarly to the tool of the first aspect, and with generally the same preferred additional features and characteristics. Here, however, the tool is for use with a ballast in which one of the half-connectors has an associated retaining edge, and the other of the half-connectors has an associated resiliently mounted retaining member that engages the retaining edge.

In this second aspect of the invention, preferred embodiments of the tool include generally the same fulcrum means, advancement means and handle means introduced above. Also included here are some means for depressing the resiliently mounted retaining member to reduce required insertion force of one half-connector into the other half-connector.

These means, the "depressor means", perform this function simultaneously with action of the advancement means in pushing the external half-connector so as to effect relative motion of the retaining member past the retaining edge. This aspect of the invention accordingly addresses and resolves the part of the assembly problem which arises from the second component of frictional forces discussed earlier.

By depressing the retaining member while that member and the retaining edge are undergoing relative motion, the tool eliminates that second component of friction, thus lowering the insertion force needed. Some force penalty of course is incurred in the effort required to depress the retaining member.

Depending on details of the half-connector design—particularly materials of construction, surface finish and angle of the inclined plane, thickness and stiffness of the retaining member, etc.—the overall or net force saving may be very significant. Accordingly if desired the connector design used can be optimized to enhance the benefits of using the tool.

If the retaining edge is formed as a portion of its associated half-connector—either the internal or external half-connector—then in use the depressor means depress the resiliently mounted retaining member during motion of the retaining member past that edge-forming portion of the associated half-connector. On the other hand, if the retaining edge is formed as a portion of the ballast case and the resiliently mounted retaining member is formed as a part of the external half-connector, then in use the depressor means depress the retaining member during motion of the retaining member past that edge-forming portion of the ballast case.

In preferred embodiments of a third major facet or aspect, the invention is a combination including an electrical-illumination ballast that has a case—the case having a wall that has an aperture—and also including an electrical internal half-connector secured to the ballast, in prealignment with the aperture.

The combination also includes a retaining edge associated with the aperture and the internal half-connector, and an electrical external half-connector to be positioned at the aperture in engagement with the internal half-connector. One of the half-connectors has an associated resiliently mounted retaining member that engages the retaining edge.

Also included in the combination is an assembly tool for use in assembling the external half-connector to the ballast. The assembly tool includes fulcrum means, advancement means, depressor means, and manually operable handle means generally as in the tool of the second aspect of the invention.

The depressor means, as in that second aspect, are for depressing the resiliently mounted member to reduce required insertion force of one half-connector into the other while the advancement means push the external half-connector so as to effect relative motion of the retaining member past the retaining edge The foregoing may represent a definition or description of the third facet of the invention in its most general or broad form. The same preferred forms as enumerated earlier for the first and second aspects of the invention are applicable as well to this third facet.

This aspect of the invention also exists in more specific forms in which the interactions of the ballast-associated elements with the tool are more acute—for example, when the fulcrum means of the tool are engaged to stabilize the tool, the advancement means are forcibly abutted with the external half-connector to move the two half-connectors into mutual engagement, and the depressor means are forcibly abutted with the resiliently mounted member to depress that member.

In preferred embodiments of still a fourth major facet or aspect, the invention is a method for assembling an electrical external half-connector into an electrical-illumination ballast. The ballast to which the method is applied has a case, and the case has a wall that in turn has an aperture; the ballast also has an electrical internal half-connector at the aperture.

The external half-connector to which the method is applied is positionable at the aperture to engage the internal half-connector. One of the half-connectors has an associated retaining edge, and the other of the half-connectors has an associated resiliently mounted retaining member that engages the retaining edge.

The method employs an assembly tool. The tool has some means for stabilizing the tool relative to the case, and has advancement means for pushing the external half-connector into engagement with the internal half-connector, and has depressor means for depressing the retaining member.

The method includes the steps of grasping the assembly tool, and engaging the stabilizing means of the tool to stabilize the tool relative to the ballast case. The method also includes the step of operating the tool to simultaneously force the advancement means against the external half-connector (thus inserting one of the half-connectors into the other) and force the depressor means against the resiliently mounted retaining member.

In this method, the forcing of the depressor means against the retaining member causes a reduction of required insertion force while the advancement means push the retaining member past the retaining edge. In other words, the required insertion force is reduced specifically at the time when the retaining member and retaining edge are undergoing relative motion to pass each other.

In this method the stabilizing means do not necessarily include a fulcrum, and the forcing of the advancement means against the external half-connector is not necessarily by rotation about a fulcrum. Rather other means may be employed for providing the desired force levels without great exertion by the assembly worker—power assist, for instance, or other mechanical-advantage devices such as a carriage operating at low friction along an inclined plane, etc.

We prefer, however, that the stabilizing means of the tool include a fulcrum for engagement with means secured to the ballast, and that the tool have handle means for operating the tool in rotation about the fulcrum. Such a system is preferable in terms of economy and simplicity in both manufacture and use.

Correspondingly we prefer that the the stabilizing-means-engaging step of the method which is the fourth aspect of the invention include engaging the fulcrum with means secured to the ballast; and that the tool-operating step include rotating the tool by its handle means—about the fulcrum means—to employ a mechanical advantage in inserting one of the half-connectors into the other.

All of the foregoing operational principles and advantages of the present invention will be more fully appreciated upon consideration of the following detailed description, with reference to the appended drawings, of which:

BRIEF DESCRIPTION OF THE DRAWINGS

FIG. 3 is a somewhat schematic elevation, mostly in longitudinal section, of the tool, ballast and connectors—similarly showing the same tool in position for use, and engaged for use with mounting holes of the ballast, but without application of any force to the handle;

FIG. 4 is a like view now showing the tool engaged for use and with application of some force to the handle to depress the retaining member, but before the external half-connector has moved significantly;

FIG. 5 is a like view showing the tool advanced to insert the external half-connector most of the way into position;

FIG. 8 is a bottom plan view of the tool;

FIG. 9 is a view generally like the lower part of FIG. 3, but of a variant form of the invention in which the fulcrum tines engage a separate fastener that secures the ballast into the luminaire, rather than engaging the mounting holes.

DETAILED DESCRIPTION OF THE PREFERRED EMBODIMENTS

Figure 1:
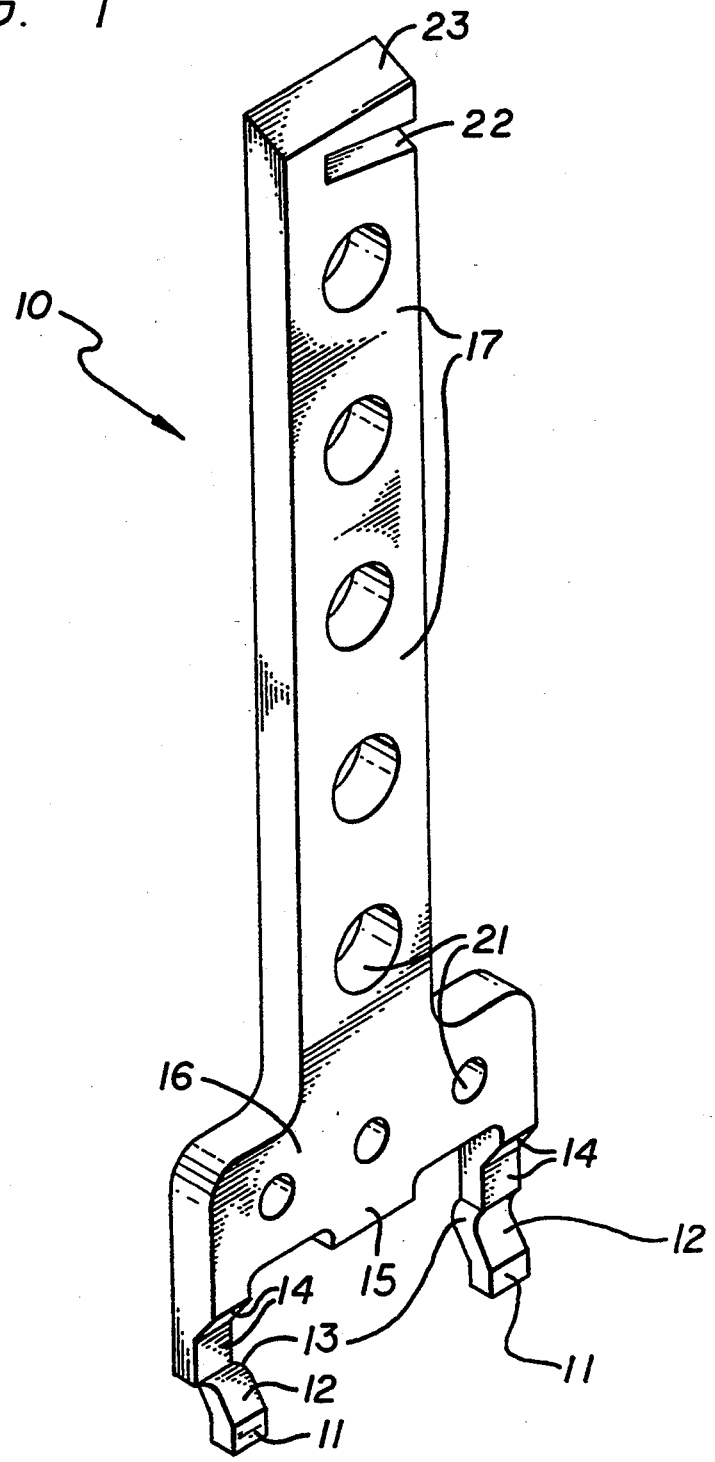
FIG. 1 is a perspective or isometric view of a preferred embodiment of an assembly tool according to the invention.

As the drawings show, a preferred embodiment of the tool 10 of the invention preferably has a yoke-shaped engagement end 11–16, terminating in angled tines 11 that serve as a two-point fulcrum. A short, strong central tongue 15 extends within the yoke for advancing the external half-connector 40 while depressing the hook or retaining member 44.

Figure 6:
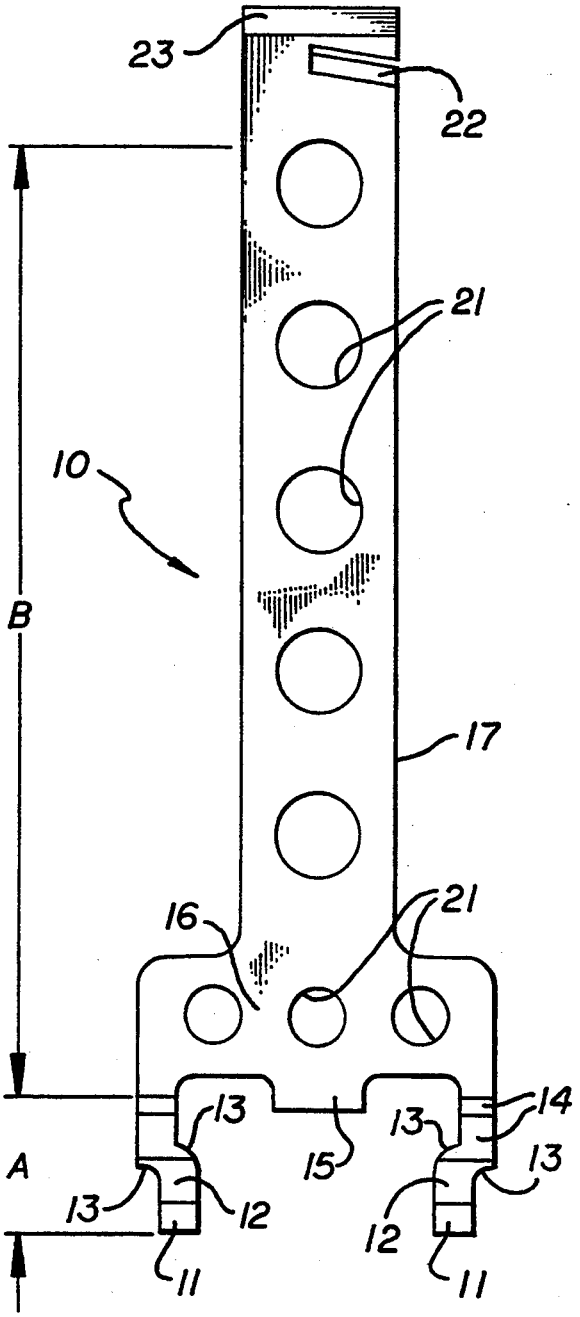
FIG. 6 is a front elevation of the same tool.
Figure 7:
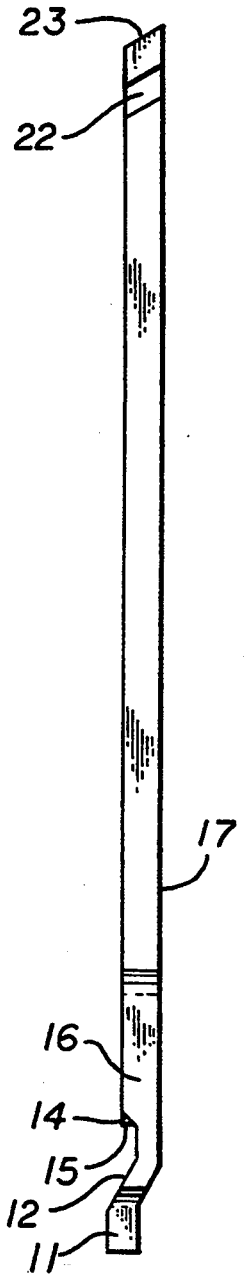
FIG. 7 is a side elevation of the tool.

The tool 10 also has a handle 17 extending from the yoke 11–16, in a direction opposite to the tongue 15, for obtaining a mechanical advantage in use of the tool 10 as a lever. Preferably the distance A (FIG. 6), along the long dimension of the tool, from the engagement point of the fulcrum tines 11 to the advancement tongue 15 is, as shown, only a small fraction of the operating length B of the handle—as measured from the same engagement point to a natural position for applying force to the handle.

Advantageously in fact these two distances are roughly 1½ and fifteen centimeters (a half-inch and six inches) respectively. The mechanical advantage provided by the tool 10 is thus on the order of ten or twelve.

At the same time the dual fulcrum elements 11, once engaged, tend to stabilize the tool 10 laterally so that small lateral components of force applied inadvertently to the handle 17 tend to have no effect on the operation of the tool 10. Operation of the tool is shown more clearly in the three successive views of FIGS. 3 through 5.

In the first of these views the tool 10 is in position for application of force. The fulcrum tines 11 are engaged with mounting through-holes 62 in longitudinal flange elements 31, 39 of the ballast can 30, to stabilize the tool 10 relative to the ballast case 30, and the advancement tongue 15 is abutted with the connector 40.

In the particular engagement configuration illustrated, the holes 62 defined through the ballast flange members 31, 39 are engaged by a self-fastener 63 formed in the material of the luminaire housing 61, thus mounting the ballast to the luminaire. The luminaire housing 61 has a hole positioned for alignment with the ballast mounting hole, but the hole in the housing is formed by bending metal tangs 63 axially, upward, rather than by removing material. At assembly, the tangs 63 are bent radially outward and over the edges of the holes 62 as shown, to complete the mounting of the ballast can 30 to the luminaire housing 61.

Figure 3:
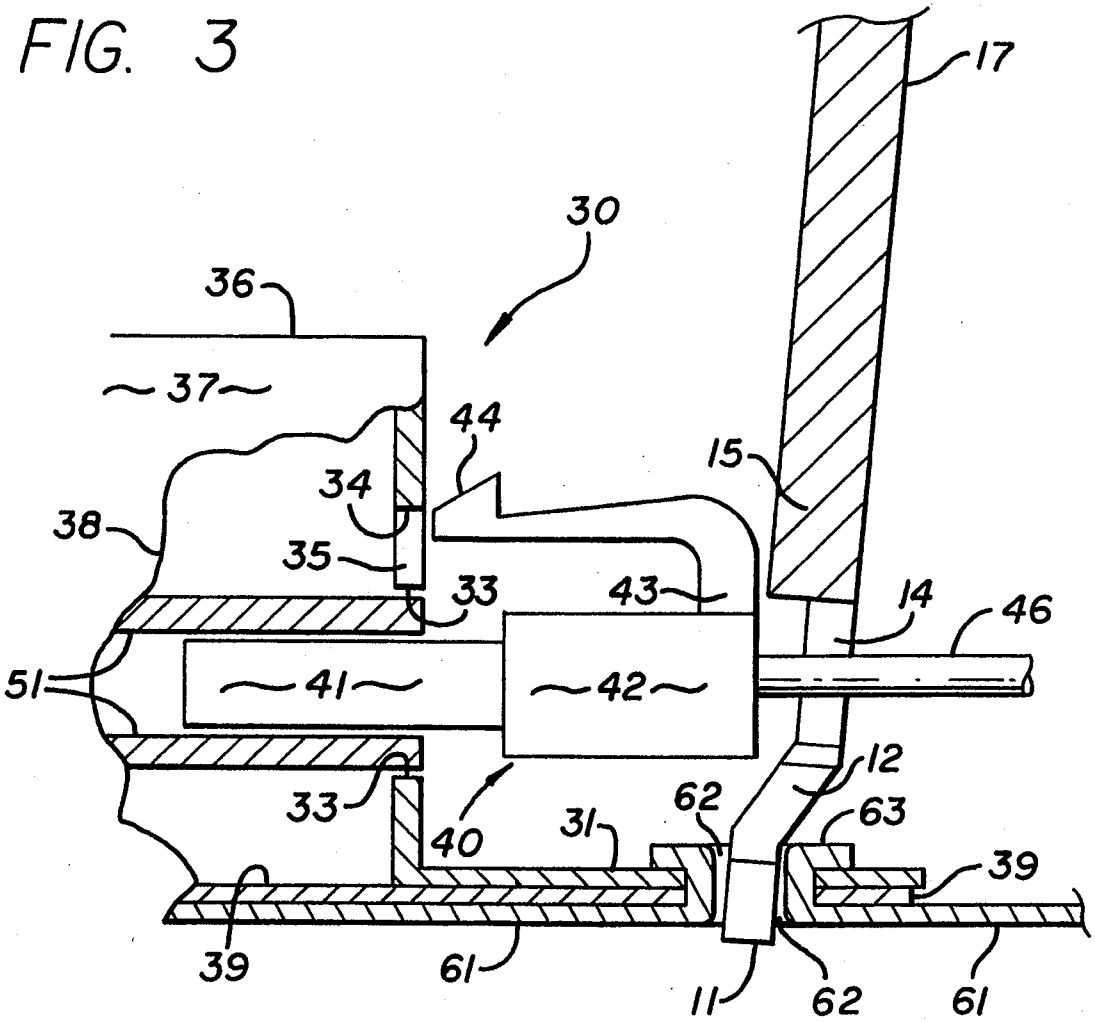
FIGS. 3 through 5 illustrate a progressive sequence of positions of the tool in use with the external half-connector; in particular

In FIG. 3 no force is as yet applied to the rear body portion 41 of the connector 40 by the advancement tongue 15 or otherwise. Reardwardly angled segments 12, lateral-dogleg segments 13 and/or forwardly angled 14 segments of the bottom end of the tool 10 are provided as necessary for the particular geometry of the connector and fulcrum-engagement point, to clear the wires 46 issuing rearward from the main body portion 42 of the connector 40.

In the second view (FIG. 4), force is being applied from the tongue 15 to the external half-connector 40. The tongue 15 is disposed and dimensioned so that it presses not against the connector body 41 proper, but rather against the shank 43 of the retaining member or latch 44—near the connector body 41, but partway out the shank 43.

Figure 4:
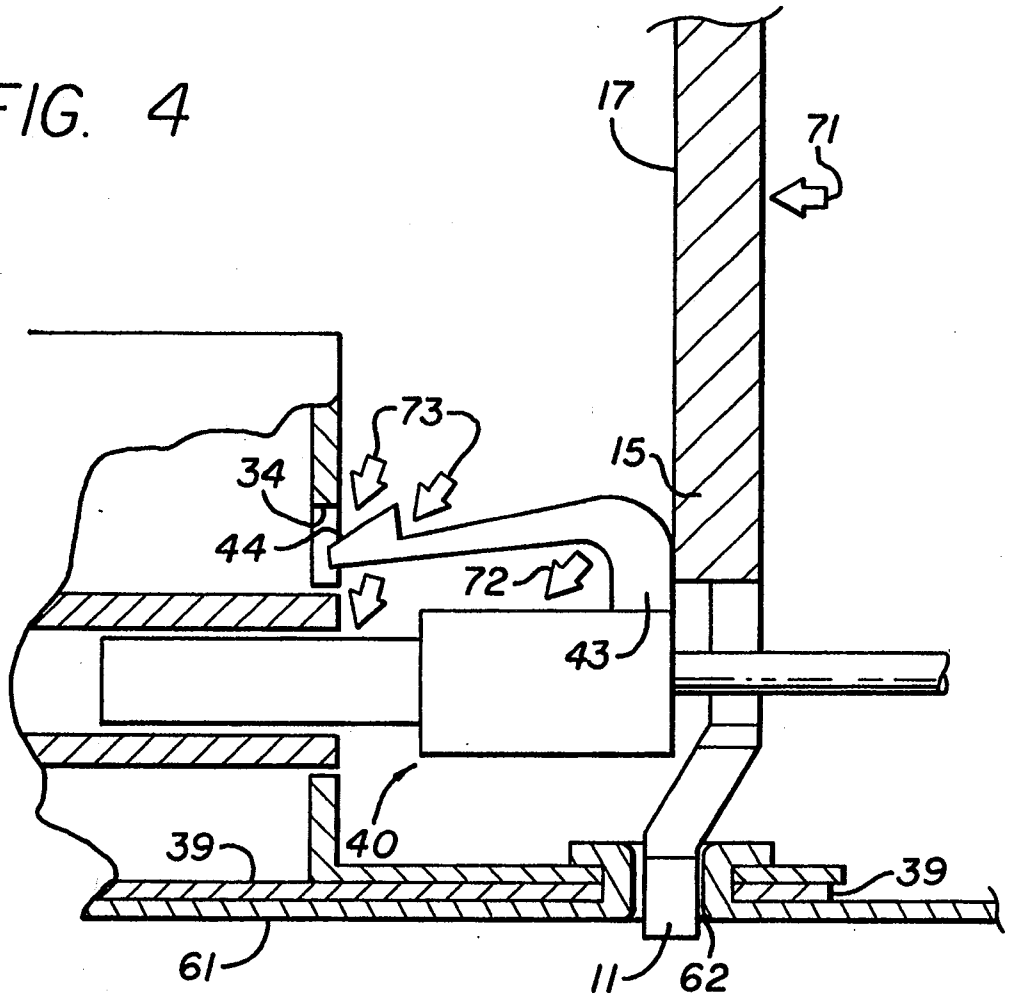

This position is carefully selected, by dimensioning of the advancement tongue 15, so that a desired degree of deflection 72 of the latch shank 43 occurs before the advancement force reaches a high enough level to bodily shift the entire half-connector 40 forward. FIG. 4 shows that the degree of forward deflection 72 at the shank is sufficient that the tip of the latch hook 44 deflects 73 downward enough to clear the retaining edge 34 associated with the other (internal) half-connector 51.

Additional deflection could be acceptable, as long as no damage to the retaining latch 43, 44 results. Those skilled in the art will find selection of a suitable engagement point straightforward, through trial and error simply as required to obtain adequate deflection 72, 73 of the shank 43 and hook 44 before the forward shifting of the half-connector 40 begins.

Figure 5:
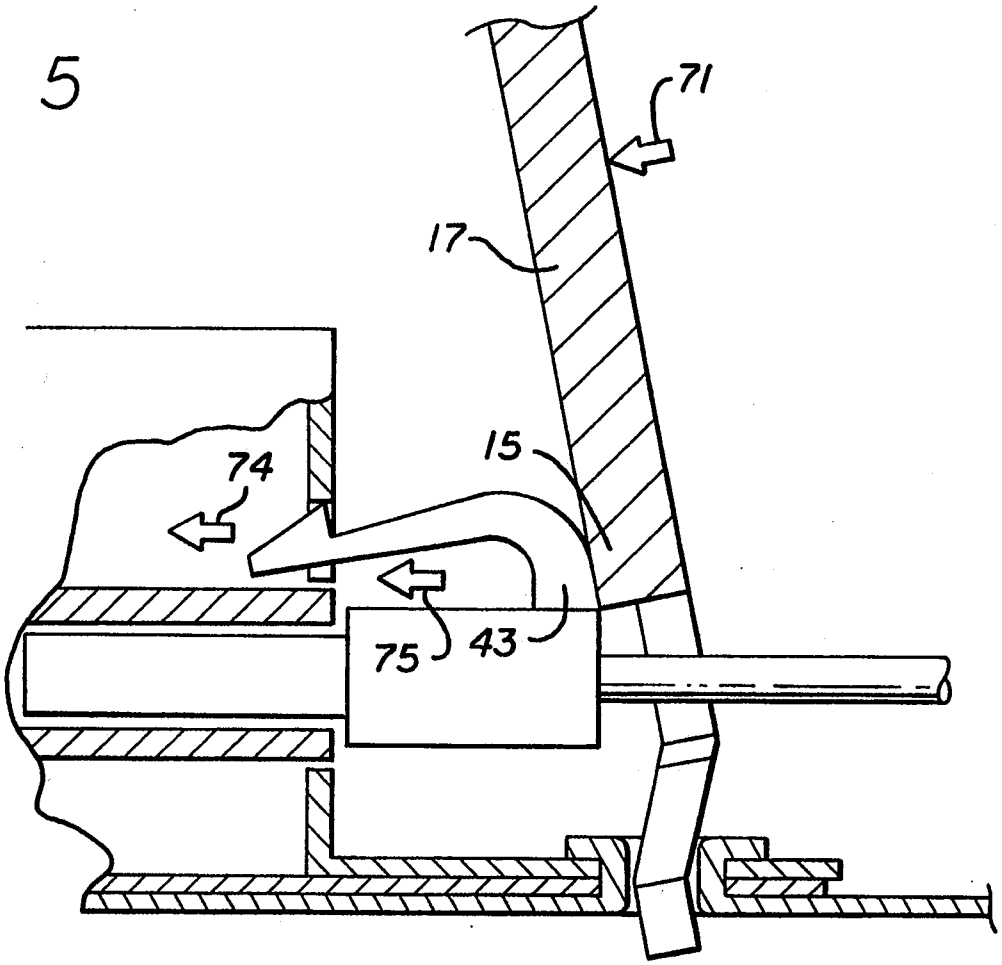

The third view, FIG. 5, of the series shows that the advancement force is now high enough to move 74, 75 the half-connector body 42 forward. This condition preferably arises simply because the root of the latch shank 43 has an effective spring constant.

The value of that constant multiplied by the accumulated displacement is a relatively large force and can overcome any static friction between the two connector halves, but more particularly between their respective pins (not shown). In event this situation does not come into play soon enough, however, other portions of the tool (not included in the tool illustrated) can if necessary be designed to reach and abut the rear end of the half-connector, and to apply advancing force through that abutment directly.

In the particular connector configuration illustrated, the retaining edge is provided in the form of a metal edge 34 of the ballast case 30. (As mentioned earlier, a retaining edge may be provided instead in the form of a part of the internal half-connector; also if desired the general geometry of the half-connectors may be reversed entirely so that the male half is internal, associated with the ballast case, and the female half is the external one. Such arrangements will be introduced shortly.)

The drawings show that in the preferred embodiment the yoke portion 11–16 of the invention must or at least should straddle the electrical leads 46 issuing from the external half-connector 40, and the advancement tongue 15 too engages the external half-connector at a point that is reasonably spaced away from the leads—so that the tool 10 pushes against the half-connector 40 without damaging the electrical leads 46. Many other equivalent arrangements for forcing the half-connector 40 into place and depressing its latch 44, while clearing the leads 46, are within the scope of the invention.

If desired the tool can be configured to avoid overdriving the external connector, in the sense of pushing so hard or so far as to damage the ballast can or either part of the connector. The tool can be made to positively abut the ballast can before it is possible for such damage to occur.

We prefer to provide an extraction slot 22 at the remote end of the handle 17, to aid in disengaging and removing the external half-connector 40 from the ballast 30 in event removal becomes desirable. To use this feature the tool 10 is first positioned, inverted, vertically between the vertical shank or leg 43 of the retaining member (latch) and the ballast case 30, and the extraction slot 22 is slid laterally into place on the horizontal leg of the latch.

The tool is then depressed to clear the retaining-member hook 44 from the mating retaining edge 34. Then while the tool is held depressed in this way, the tool handle 17 is operated forward—now if desired using the edge of the ballast can as a fulcrum—to eject the external half-connector.

Preferably each fulcrum tine has, beyond its angled portions 14, a very short end segment 11 that is parallel with (but slightly forward of) the handle so as to hook effectively onto an anchor point 63 secured to (in the illustrated configuration, part of) the ballast case 30. FIGS. 1 through 5, in particular, illustrate such engagement with an exemplary ballast that has—as already mentioned—mounting holes 62 in a longitudinally extending flange 31, 39; these holes may be used to fix the ballast can 30 to a luminaire housing 61 through use of fastening tabs 63 formed in the sheet metal of the luminaire 61 and passed through the ballast mounting holes 62—and then bent down firmly against the flange 31, 39 as illustrated.

Such a ballast-mounting geometry may be desired in that it conserves cost, since the material of construction of the luminaire itself in effect provides a fastener. The hooking features of our insertion tool, however, may diverge in form from those illustrated, as appropriate for the anchoring features on the particular ballast with which they are intended to engage.

Figure 10:
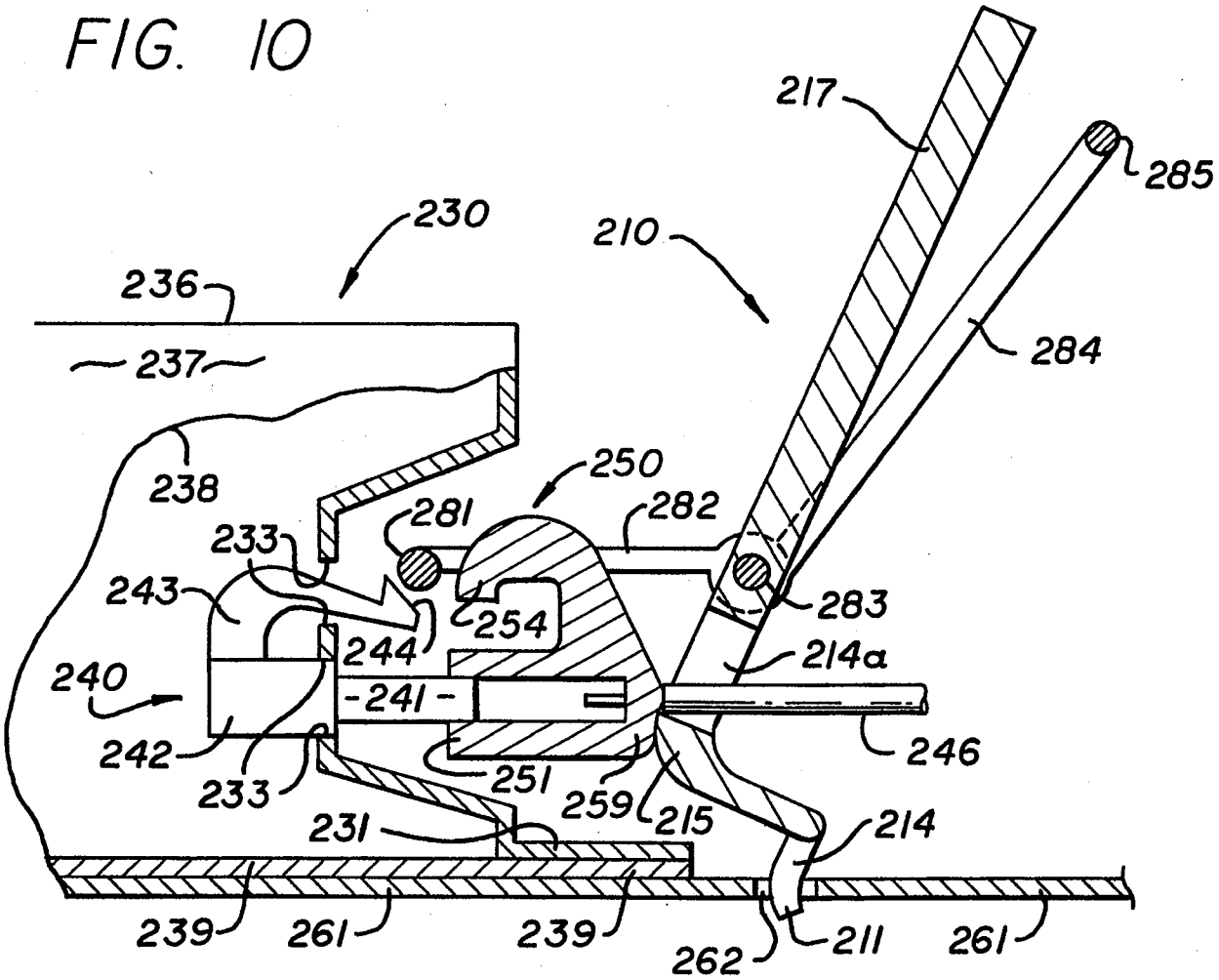
FIG. 10 is a somewhat fanciful view similar to FIG. 9 but of another variant in which the fulcrum tines engage a separate feature of the luminaire; and in which the retaining edge is provided as part of one of the half-connectors rather than as part of the ballast case, and in which also the male half-connector is the internal rather than external half.

For instance, separate through-fasteners 164 (FIG. 9) may be passed through aligned holes of the ballast 131, 139 and luminaire 161, and the fulcrum tines 111, 112 may then be shaped to engage such fasteners 164. Alternatively still, the fulcrum tines 211 (FIG. 10) may be arranged to engage holes 262 or other features separately provided for the purpose in either the luminaire (as in FIG. 10) or ballast. Various other equivalent means may be provided for engaging some feature that is generally fixed relative to the ballast case 30, 130, 230.

The invention is illustrated as employing manual rotary advancement about a fulcrum 111, 111, 211, to enjoy a mechanical advantage, As suggested earlier, however, the scope of the invention, in accordance with the recitations of certain of the appended claims, encompasses advancement by powered assist—as with an air cylinder or other source of motive power and force, and with no mechanical advantage as such.

Figure 2:
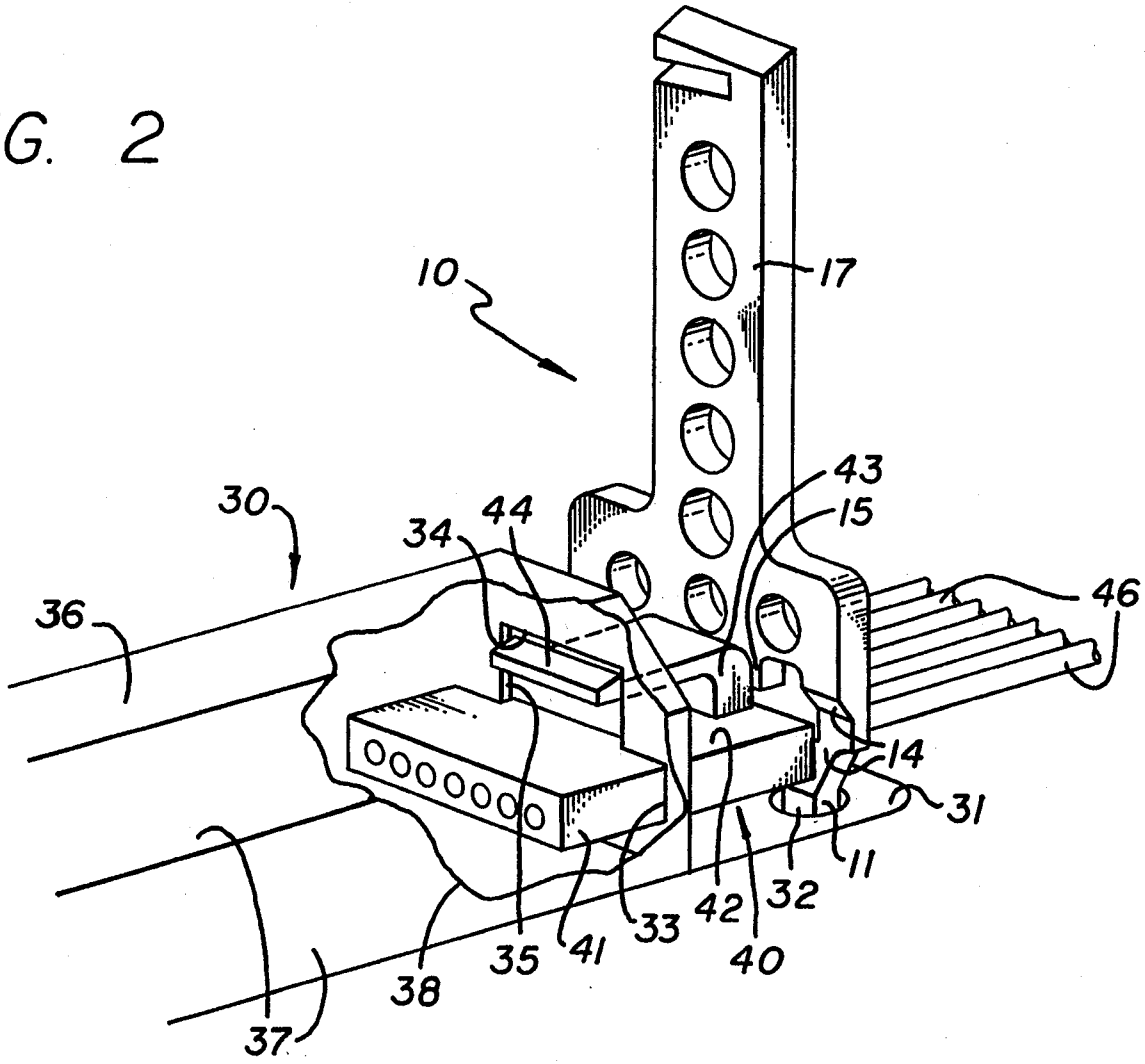
FIG. 2 is a like view of the FIG. 1 tool in position for use, engaged with mounting holes of the ballast, to aid in assembling an external half-connector to a leadless ballast, and particularly with the ballast case drawn partially broken away (and with the internal components of the ballast omitted) to more clearly illustrate the interactions with the half-connector.

The tool is illustrated in FIGS. 1 through 5, and FIG. 9, as used with a popular form of fluorescent-lighting leadless ballast in which the internal half-connector 40 is a socket or receptacle, mounted in prealignment with an end-wall aperture 33 of the ballast, and the external half is a plug. This arrangement is preferable as mentioned earlier because of minimal projections outside the ballast case. In some such instances the aperture has a retaining edge 34 defined at the far end of a side-slot 35 (FIGS. 2 and 3).

Many other locations and geometries, however, as will be clear to those skilled in the art, are equally compatible with the invention. In particular the internal half-connector 240 (FIG. 10) may be the plug (perhaps recessed to moderate breakage) and the external half 250 the receptacle.

Also, independently of which side is the plug and which is the receptacle, the retaining edge 254 may be provided as part of one of the half-connectors 250 rather than as part of the ballast case. To service a configuration in which both the plug 240 is internal and the retaining edge 254 is part of the external receptacle 250, preactuation of the resilient retaining member or latch 243, 244 may require a more elaborate tool.

For example a separate depressor bar 281 and actuator rocker arms 282, 284, pivoted 283 to the tool handle 217, might be operated manually by a transverse crossbar 285. When the crossbar 285 reaches the handle 217, the latch hook 244 has been depressed to clear the retaining edge 254.

Further advance of the crossbar 285 and handle 217 together move the external receptacle forward—one section of the connector enclosing the latch and the other enclosing the projecting smaller portion 241 of the plug 240. (As before the tool 210 has an open central portion 214*a* to clear or straddle the wires 246.) As will be understood, this configuration is illustrated to demonstrate that such alternative configurations are possible.

The tool is advantageously made of metal—forged, cast, or machined. Holes 21 are preferably formed in the tool as shown to reduce its weight.

It will be understood that the foregoing disclosure is intended to be merely exemplary, and not to limit the scope of the invention—which is to be determined by reference to the appended claims.

What is claimed is:

1. An assembly tool, for use in assembling an electrical-illumination ballast that has a case and an electrical external half-connector to be positioned at an aperture in a wall of the case; said case having an electrical internal half-connector prealigned at the aperture for engagement with the external half-connector; one of the half-connectors having an associated retaining edge, and the other of the half-connectors having an associated resiliently mounted retaining member that engages the retaining edge; said tool comprising:

a distinctly trifurcated fork structure including a cross-member and three spaced-apart elements extending from the cross-member; two outboard ones of said elements being relatively long legs and one substantially central one of said elements being a relatively short tongue which is distinctly separated from both legs by respective distinct slots therebetween;

fulcrum tips, formed at the ends of the long outboard legs for engagement in a fixed relationship to the case of such an electrical-illumination ballast, for stabilizing the tool relative to the case of such an electrical-illumination ballast;

advancement means for pushing the external half-connector into engagement with the internal half-connector;

said short central tongue forming an actuating structure that extends from the cross-member, between and spaced away from the spaced-apart legs, in substantially the same direction as the legs; said actuating structure providing depressor means for depressing the resiliently mounted retaining member to reduce required insertion force for mating of the two half-connectors while the advancement means push the external half-connector so as to effect relative motion of the retaining member past the retaining edge; and manually operable handle means for rotating the tool about the fulcrum tips, when the fulcrum tips are stabilizing the tool relative to the case, to urge the advancement means against the external half-connector to push the external half-connector into engagement with the internal half-connector while simultaneously depressing the resiliently mounted retaining member; said handle means also extending from the cross-member in a direction substantially opposite to the legs and tongue.

2. The tool of claim 1, for use particularly with a ballast case and half-connectors in which the retaining edge is formed as a portion of said one half-connector; and wherein the short central tongue:

extends from the cross-member to the resiliently mounted retaining member, when the half-connector is positioned at such aperture and the fulcrum tips are engaged for stabilization relative to the case of such ballast; and comprises means for depressing the resiliently mounted retaining member while the advancement means push the external half-connector so as to effect relative motion of the resiliently mounted retaining member past said portion of said one half-connector.

3. The tool of claim 1, for use particularly with a ballast case and half-connectors in which the retaining edge is formed as a portion of the ballast case and the resiliently mounted retaining member is formed as a part of the external half-connector; and wherein the short central tongue:

extends from the cross-member to the external half-connector, when the half-connector is positioned at such aperture and the tool is in position for use with the fulcrum tips engaged for stabilization relative to the case of such ballast; and comprises means for depressing the resiliently mounted retaining member while the advancement means push the external half-connector so as to effect relative motion of the resiliently mounted retaining member past said portion of the ballast case.

4. The tool of claim 1, for use particularly with a case that has means for mounting the case to a luminaire; and for use particularly with such an external half-connector that has wires extending therefrom, said wires extending outward relative to the ballast case when the external half-connector is positioned at said aperture in the case wall; and wherein:

the fulcrum tips comprise elements for engaging the case-to-luminaire mounting means; and when the half-connector is positioned at such aperture and the tool is in position for use, with the fulcrum tips engaged with the case-to-luminaire mounting means, the short central tongue;

extends from the cross-member to the external half-connector, but stops short of such wires extending from the external half-connector.

5. The tool of claim 4, for use particularly with a case whose case-to-luminaire mounting means comprise a longitudinally extending flange and means defining at least one ballast-mounting hole in the flange; and wherein:

the fulcrum tips comprise elements for engaging the at least one ballast-mounting holes; and when the half-connector is positioned at such aperture and the tool is in position for use, with the fulcrum tips engaged with the at least one ballast mounting hole, the short central tongue:

extends from the cross-member to the external half-connector, but stops short of such wires extending from the external half-connector.

6. The tool of claim 4, for use particularly with a case whose case-to-luminaire mounting means comprise means defining at least one hole for passage of at least one fastener that engages such a luminaire; and wherein:

the fulcrum tips comprise elements for engaging the at least one fastener; and when the half-connector is positioned at such aperture and the tool is in position for use, with the fulcrum tips engaged with the at least one fastener, the short central tongue:

extends from the cross-member to the external half-connector, but stops short of such wires extending from the external half-connector.

7. The tool of claim 1, wherein:

the short central tongue forms said actuating structure as a single, unitary element that provides both the depressor means and the advancement means in common.

8. In combination:

an electrical-illumination ballast that has a case, said case having a wall that has an aperture;

an electrical internal half-connector secured to the ballast, in prealignment with the aperture;

an electrical external half-connector to be positioned at the aperture in engagement with the internal half-connector;

one of the half-connectors having an associated retaining edge;

the other of the half-connectors having an associated resiliently mounted retaining member that engages the retaining edge; and an assembly tool for use in assembling the external half-connector to the ballast and comprising:

fulcrum means for stabilizing the tool in relation to the case of the ballast, advancement means for pushing the external half-connector into engagement with the internal half-connector, depressor means for depressing the resiliently mounted member to reduce required insertion force for mating of the two half-connectors to each other while the advancement means push the external half-connector so as to effect relative motion of the retaining member past the retaining edge, and manually operable handle means for moving the tool about the fulcrum means, when the fulcrum means are engaged to stabilize the tool in relation to the case, to urge the advancement means against the external half-connector to push the external half-connector into engagement with the internal half-connector while simultaneously depressing the resiliently mounted retaining member.

9. The combination of claim 8, wherein:

the fulcrum means of the tool are engaged to stabilize the tool in relation to the case;

the advancement means are forcibly abutted with the external half-connector to move the external half-connector into engagement with the internal half-connector so as to effect relative motion of the retaining member past the retaining edge; and the depressor means are forcibly abutted with the resiliently mounted member to depress the resiliently mounted member so as to reduce required insertion force of one half-connector into the other.

10. The combination of claim 8, wherein:

the retaining edge is formed as a portion of its associated half-connector; and the depressor means comprise means for depressing the resiliently mounted retaining member while the advancement means push the external half-connector so as to effect relative motion of the resiliently mounted retaining member past said portion of said associated half-connector.

11. The combination of claim 8, wherein:

the retaining edge is formed as a portion of the ballast case;

the resiliently mounted retaining member is formed as a part of the external half-connector; and the depressor means comprise means for depressing the resiliently mounted retaining member while the advancement means push the external half-connector so as to move the resiliently mounted retaining member past said portion of the ballast case.

12. The combination of claim 8, wherein:

the assembly tool comprises a unitary actuating structure that forms both the depressor means and the advancement means.

13. A method for assembling an electrical external half-connector into an electrical-illumination ballast; said ballast having a case, and said case having a wall that has an aperture and having an electrical internal half-connector at the aperture; the external half-connector being positionable at the aperture to engage the internal half-connector; one of the half-connectors having an associated retaining edge, and the other of the half-connectors having an associated resiliently mounted retaining member that engages the retaining edge; said method employing an assembly tool that has means for stabilizing the tool relative to the case and has advancement means for pushing the external half-connector into engagement with the internal half-connector and has depressor means for depressing the retaining member; said method comprising the steps of:

grasping the assembly tool;

engaging the stabilizing means of the tool to stabilize the tool relative to the ballast case;

operating the tool to simultaneously force the advancement means against the external half-connector, inserting one of the half-connectors into the other, and force the depressor means against the resiliently mounted retaining member;

wherein said forcing of the depressor means against the retaining member causes a reduction of required insertion force while the advancement means push the retaining member past the retaining edge.

14. The method of claim 13, for use particularly with a tool whose stabilizing means comprise a fulcrum for engagement with means secured to the ballast, and which has handle means for operating the tool; and wherein:

the stabilizing-means-engaging step comprises engaging the fulcrum with the means secured to the ballast; and the tool-operating step comprises rotating the tool by its handle means, about the fulcrum means, to employ a mechanical advantage in inserting one of the half-connectors into the other.

15. The method of claim 13, particularly for use with such assembly tool which has a unitary actuating structure that forms both the depressor means and the advancement means; and wherein:

the tool-operating step comprises applying force through the unitary actuating structure against only the resiliently mounted retaining member to both;

deform the resiliently mounted retaining member so as to clear the retaining edge; and push forward the half-connector that is associated with the resiliently mounted retaining member so as to advance the two half-connectors together.

* * * * *